United States Patent [19]

Akimoto et al.

[11] Patent Number: 4,931,375

[45] Date of Patent: Jun. 5, 1990

[54] POWDERED ELECTROSTATIC IMAGE DEVELOPING TONER

[75] Inventors: Kunio Akimoto; Satoru Ikeuchi; Yoshio Takizawa, all of Hachioji, Japan

[73] Assignee: Konishiroku Photo Industry Co., Ltd., Tokyo, Japan

[21] Appl. No.: 355,126

[22] Filed: May 19, 1989

Related U.S. Application Data

[63] Continuation of Ser. No. 75,094, Jul. 20, 1987, abandoned.

[30] Foreign Application Priority Data

Jul. 22, 1986 [JP] Japan ..... 61-170897

[51] Int. Cl.[5] ..... G03G 9/08

[52] U.S. Cl. ..... 430/109; 430/99; 430/120

[58] Field of Search ..... 430/109, 99, 120

[56] References Cited

U.S. PATENT DOCUMENTS

| | | | |
|---|---|---|---|
| 2,297,691 | 10/1942 | Carlson | 430/120 X |
| 3,268,351 | 8/1966 | Van Dorn | 430/99 |
| 4,287,280 | 9/1981 | Swift | 430/99 |
| 4,288,517 | 9/1981 | Arimatsu et al. | 430/99 X |
| 4,528,257 | 7/1985 | Polderman et al. | 430/109 |

FOREIGN PATENT DOCUMENTS

| | | |
|---|---|---|
| 220319 | 5/1987 | European Pat. Off. . |
| 3105985 | 12/1981 | Fed. Rep. of Germany . |
| 1478417 | 6/1977 | United Kingdom . |

*Primary Examiner*—J. David Welsh

*Attorney, Agent, or Firm*—Jordan B. Bierman

[57] ABSTRACT

Disclosed is a toner powder for developing latent electrostatic images comprising as a binder for pigment material a block or graft copolymer composed of a crystalline polyester and an amorphous vinyl polymer. The amorphous vinyl polymer has at least two peaks in its molecular weight distribution curve. One is between 100,000 and 1,000,000 and another is between 2000 and 20,000.

48 Claims, No Drawings

POWDERED ELECTROSTATIC IMAGE DEVELOPING TONER

This application is a continuation of application Ser. No. 075,094, filed July 20, 1987, now abandoned.

FIELD OF THE INVENTION

The present invention relates to an electrostatic image developing toner for use in developing electrostatic latent images which are formed in the electrophotographic process, electrostatic printing process, electrostatic recording process and the like.

BACKGROUND OF THE INVENTION

In the electrophotographic process, in general, an electrostatic image carrier comprised of a photoconductive photoreceptor is charged and then imagewise exposed to form an electrostatic latent image thereon. The formed electrostatic latent image is then developed by a toner prepared in the particulate form by incorporating a coloring agent or the like into a binder resin. The toner image thus obtained is then transferred onto a suitable transferer such as copying paper, and is finally fixed onto the transferee, whereby a visible image is formed.

Thus, in order to obtain a visible image it is necessary to fix the toner image. For this purpose, the heat roller fixing process, which has a high thermal efficiency and is capable of rapidly fixing, has been conventionally used.

In recent years, however, the reduction of the fixing heater's power consumption to enable the fixation to be made at a lower heat roller temperature has now been strongly demanded from the necessities of (a) restraining the deterioration of copying apparatus due to overheat, (b) preventing the photoreceptor from being thermally deteriorated, (c) shortening the warming-up time required for the heat roller to be heated up to a temperature ready for fixation after the start of the fixing device's operation, (d) reducing the drop of the heat roller temperature due to the absorption of heat by copolying paper to thereby enable running copying operations to make a large number of copies in succession, (e) raising the thermal stability, and the like. Accordingly, the toner also is required to be satisfactorily fixed at a lower temperature.

Further, the toner should be present in the powdery form without adhering under the using or storage environmental condition; i.e., the toner is required to be excellent in the antiblocking property. In addition, in the heat roller fixing process, which is considered suitable for fixing, an undesirable phenomenon that a part of the toner constituting an image is transferred at the time of fixation onto the heat roller surface and the part is then retransferred onto the subsequent copying paper to stain the image thereof, the so-called offset phenomenon, tends to occur, so that the toner needs to have a capability of preventing the occurrence of the offset phenomenon; i.e., resistance to the offset phenomenon.

Thus, there have heretofore been proposals of a technique to use a polymer, as the binder resin constituting a toner, which is formed by chemically combining at least one crystalline polymerizable part having a melting point of from 45° C. to 150° C. with a noncrystalline polymerizable part having a glass transition point of below 0° C., as disclosed in, e.g., Japanese Patent Publication Open to Public Inspection (hereinafter referred to as Japanese Patent O.P.I. Publication) No. 87032/1975, and a technique to use a thermoplastic polymer, as the binder resin constituting a toner, which contains in the molecule thereof a crystalline block having a melting point of from 45° C. to 90° C. and a noncrystalline block whose glass transition point is at least 10° C. higher than the melting point of the crystalline block, and the crystalline block content of which polymer is from 70% to 95% by weight, as disclosed in Japanese Patent O.P.I. Publication No. 3446/1984.

Also Japanese Patent O.P.I. Publication No. 154740/1981 discloses a toner containing a graft copolymer comprised of a crystalline polymer formed with one or two or more monomers selected from the group consisting of ethylene, propylene and vinyl acetate, and an amorphous polymer formed with one or two or more of vinyl polymers, and further Japanese Patent O.P.I. Publication No. 8549/1982 discloses a toner containing a graft copolymer comprised of a crystalline trunk polymer part formed with at least one monomer selected from the group consisting of ethylene, propylene and vinyl acetate, an unsaturated polyester trunk polymer part, and a vinyl-type branched polymer part.

However, the toner disclosed in the foregoing Japanese Pat. No. 87032/1975, since it is a toner constituted by a copolymer formed by chemically combining a soft crystalline polymer part with an adhesive and soft noncrystalline polymer part having a glass transition point of below 0° C. is disadvantageous in respect of causing a blocking phenomenon on the developing device and the like. In addition, the toner is poor in the developability because it is inferior in the triboelectrification as well as in the fluidity, thus producing a foggy, unclear image. Furthermore, the toner is so soft that it causes a filming phenomenon that it comes to adhere to the carrier grains or to the photoreceptor's surface after making a large number of copies, and then further comes to adhere to cleaning members such as the cleaning blade, thus resulting in the formed image being foggy and unclear with a low density, And this toner is caused by its softness to tend to agglomerate or to be hardly pulverized in the pulverizer when it is to be pulverized thereby at normal temperature, and thus the softness makes it impossible to obtain any desired grain size-having toner, lowers the production efficiency, and raises the production cost. Besides, this toner has a so high adhesiveness as to cause an offset phenomenon on a non-oil coated heat roller fixing device.

Also, in the technique disclosed in the foregoing Japanese Patent O.P.I. Publication No. 3446/1984, since it uses a noncrystalline block having a glass transition point as high as more than 100° C., a crystalline block in an amount as large as 70 to 95% by weight must be used in order to meet the requirement of the fusibility at a low temperature, so that the nature of the soft crystalline block having a plasticity at room temperature is to be reflected upon the toner. That is, this toner is poor in the developability due to the inferior triboelectrification and fluidity because of its softness, thus producing foggy and not clear images. In addition, after a number of copying operations there occurs a filming phenomenon that the toner adheres to carrier grains or to the photoreceptor surface, and the triboelectrification becomes further deteriorated, and the toner comes to fusedly adhere to cleaning members such as the cleaning blade, thus producing foggy, unclear images with a low density. Further, in the thermally fixing method wherein fixation is performed in a short period by the application of a less oil-coated heat roller fixing device, since the above noncrystalline block's glass transition point is as high as 100° C., the fixable temperature is increased, and since at the same time the amount of the crystalline block is as large as 70 to 95% by weight, the offset phenomenon tends to occur.

In addition, the toner as disclosed in the foregoing Japanese Patent O.P.I. Publication No. 154740/1981 or 8549/1982 is so poor in the fluidity that no developer in which the toner is uniformly dispersed onto carriers can be obtained, resulting in obtaining no toner having adequate triboelectrification and developability, and thus a partially skipping trouble occurs on the resulting image, making it illegible. Besides, in a number of copying operations, this toner, due to its poor fluidity, even when replenished, is not uniformly dispersed into the developer, thus producing unclear images.

As has been described above, the state of arts has been that toner which is free from these shortcomings has not yet been put into practical use.

SUMMARY OF THE INVENTION

The present invention has been made in view of the above-mentioned circumstances.

It is therefore a first object of this invention to provide an electrostatic image developing toner capable of being fixed at a low temperature and having a improved anti-offset property and a wide fixable temperature range.

It is a second object of this invention to provide an electrostatic image developing toner which has improved offset prevention effect even in the non-oil-coated heat roller fixing process.

It is a third object of this invention to provide an electrostatic image developing toner which is excellent in such characteristics as the anti-blocking property, fluidity, triboelectrification stability, developability, and the like and which produces no fog and provides a high image density, thus producing a clear image.

The present invention relates to an electrostatic image developing toner comprising a block copolymer or graft copolymer as a binder component, said block or graft copolymer containing therein a crystalline polyester and, chemically combined therewith, an amorphous vinyl polymer having a functional group which is capable of forming a chemical bond with said crystalline polyester, said amorphous vinyl polymer having at least two peaks in its molecular weight distribution curve.

The electrostatic image developing toner of this invention is characterized by (1) a block copolymer or graft copolymer, obtained by chemically combining a crystalline polyester with an amorphous vinyl copolymer having a functional group which is capable of combining with the crystalline polyester, is used as a main binder component and (2) the amorphous vinyl copolymer has at least two peaks in its molecular weight distribution curve.

DETAILED DESCRIPTION OF THE INVENTION

In the toner of this invention, a material formed by the chemical combination of a crystalline polyester with an amorphous vinyl polymer is used as the binder for the toner. And it is an essential requirement of the present invention that the amorphous vinyl polymer has at least two peaks in its molecular weight distribution and has a functional group which is capable of forming a chemical bond with the crystalline polyester to form a block copolymer or graft copolymer.

Such the toner, since its binder contains the above copolymer, enables to obtain a fixability at a low temperature and a satisfactory wetness in fusing due to the presence of a crystalline polyester component and, at the same time, the binder also exerts resistance against offset phenomenon due to the presence of the amorphous vinyl polymer component which contributes to the fixability at a low temperature. As a result, in the formation of a visible image from an electrostatic image, an excellent resistance to the offset phenomenon and a satisfactory fixability at a low temperature along with a wide fixable temperature range can be obtained, and, in addition, a satisfactory antiblocking property and fluidity can also be obtained, thus making it possible to form an excellent visible image repeatedly in a number of copying operations. Further by the use of the toner of the present invention, owing to its improved fixing ability at a low temperature, it becomes possible that the fixing temperature to be set with a fixing device of a copying machine can be lowered, and the life of such fixing device can be prolonged. In the above-mentioned fixing process, it is preferable that the fixation should be carried out in a contact heating method by making use of a heat-roller type fixing means having a heat-roller. As for the heat-rollers, those having a surface coated with a fluororesin or a silicone resin may preferably be used. Such heat-roller type fixing means is usually comprised of a heat-roller, a back-up roller arranged face to face to the heat-roller and a heat source for heating the heat-roller, or, in addition thereto, a cleaning roller arranged also face to face to the heat-roller. To be more concrete, the heat-rollers preferably used include, for example, those having such a structure that a coated layer comprising a fluororesin such as Teflon (a polytetrafluoroethylene, manufactured by Du Pont) or a silicone resin is provided to the surface of a core member comprising a metal such as iron, aluminium or the like. On the other hand, the back-up rollers preferably used include, for example, those having such a structure that a coated layer comprising silicone rubber or the like is provided to the surface of a core member made of a metal.

The foregoing amorphous vinyl polymer, since it form a block or graft copolymer with the crystalline polyester, preferably has a carboxyl group, a hydroxyl group, an amino group or an epoxy group as the functional group.

Examples of monomers, which give the amorphous vinyl polymer and which have such a functional group, include acrylic acid, $\beta,\beta$-dimethylacrylic acid, $\alpha$-ethylacrylic acid, fumaric acid, itaconic acid, maleic acid. crotonic acid, hydroxyethyl methacrylate, acryloyloxyethyl monophthalate, acryloyloxyethyl monosuccinate, N-hydroxyethylacrylamide, N-hydroxyethyl-methacrylamide, N-methylolacrylamide, p-aminostyrene, glycidyl methacrylate, and the like. Such the functional group-having monomer is used in the quantity range of from 0.1 to 20 mole %, and preferably from 0.5 to 10 mole % in the monomer composition for obtaining the amorphous vinyl polymer.

The vinyl polymer for use in constituting the principal part of the amorphous vinyl polymer is not particularly restricted as long as it is one comprising a monomer component having such a functional group, and examples of it include polystyrenes, polymethyl methacrylates, polymethyl acrylates, polyvinyl chlorides, polyvinyl acetates, polyacrylonitriles and others. Among these polymers, styrene-type polymers, acryl-type polymers and styrene-acryl-type polymers are particularly suitable as the amorphous vinyl polymer. Examples of those monomers providing these polymers include styrene, o-methylstyrene, m-methylstyrene, p-methylstyrene. α-methylstyrene, p-ethylstyrene, 2,4-diethylstyrene, p-n-butylstyrene, p-dodecylstyrene, p-methoxystyrene, p-phenylstyrene, p-chlorostyrene, methyl acrylate, ethyl acrylate, n-butyl acrylate, 2-ethylhexyl acrylate, lauryl acrylate, stearyl acrylate, methyl methacrylate, ethyl methacrylate, n-propyl methacrylate, n-butyl methacrylate, tert-butyl methacrylate, 2-ethylhexyl methacrylate, lauryl methacrylate, stearyl methacrylate, cyclohexyl methacrylate, dimethylaminoethyl methacrylate, and the like. These monomers may be used alone or in combination.

It is an essential requirement of the present invention that the amorphous vinyl polymer has at least two peaks in its molecular distribution measured by gel permeation chromatography (hereinafter abbreviated hereinafter as G.P.C.). According to one of the preferable embodiments of the present invention, at least one peak molecular weight resides within the range of 100,000 to 1,000,000 and at least one other peak molecular weight resides within the range of 2,000 to 20,000.

The amorphous vinyl polymer has its glass transition point (Tg) preferably in the range from 50° C. to 100° C., and particularly preferably from 50° C. to 85° C. If the glass transition point Tg is less than 50° C., there will be a tendency that the antiblocking property becomes degraded, while if it exceeds 100° C., it tends to lower the fusion fluidity of the toner at a low temperature which deteriorates the fixability. The terms 'glass transition point (Tg)' of the amorphous vinyl polymer implies the glass transition point of the amorphous vinyl polymer itself in the condition where it is not combined with the crystalline polyester.

A crystalline polyester is used as the component to be chemically combined with the above-mentioned amorphous vinyl polymer to thereby form the block copolymer or graft copolymer. The crystalline polyester, although not restricted, is particularly preferably a polyalkylene polyester. Examples of the polyalkylene polyester include polyethylene sebacate, polyethylene adipate, polyethylene suberate, polyethylene succinate, polyethylene-p-(carbophenoxy) undecaate, polyamethylene, oxalate, polyhexamethylene sebacate, polyhexamethylene decanedioate, polyoctamethylene dodecanedioate, polynonamethylene azelate, polydecamethylene adipate, polydecamethylene azelate, polydecamethylene oxalate, polydecamethylene sebacate, polydecamethylene succinate, polydecamethylene dodecanedioate, polydecamethylene octadecanedioate, polytetramethylene sebacate, polytrimethylene dodecandioate, polytrimethylene octadecanedioate, polytrimethylene oxalate, polyhexamethylene-decamethylene sebacate, polyoxydecamethylene-2-methyl-1,3-propane dodecanedioate, and the like.

The use of any of the above-mentioned polyalkylene polyesters enables to obtain an effective low-temperature fixability of the toner and to improve the fluidity of the toner.

The foregoing crystalline polyester is desirable to have a melting point (Tm) of from 50° C. to 120° C., and particularly from 50° C. to 100° C. If the melting point (Tm) of the crystalline polyester to be used is less than 50° C., the antiblocking property of the toner becomes less satisfactory, while if it exceeds 120° C., the fusion fluidity of the toner at a low temperature tends to be lowered, thus possibly deteriorating the fixability. The 'melting point (Tm)' crystalline polyester herein means the melting point of the crystalline polyester itself in the condition where it is not combined with the amorphous vinyl polymer.

In the crystalline polyester, the weight average molecular weigh Mw is preferably from 5,000 to 50,000, and the number average molecular weight Mn is preferably from 2,000 to 20,000. If the molecular weight is in these ranges, the anti-offset property of the toner and the pulverizing efficiency of the toner in the manufacture are further improved.

As regards the using ratio of the above crystalline polyester, the ratio of the crystalline polyester component to the block copolymer or graft copolymer formed by the combination of the amorphous vinyl polymer therewith is preferably from 3 to 50% by weight, and more preferably from 5 to 40% by weight, If this ratio is less than 3% by weight, the obtained toner tends to have a high minimum fixation temperature, while if it exceeds 50% by weight, the fusion-elasticity modulus of the toner in fixation tends to be lessened, deteriorating the anti-offset property.

The crystalline polyester and the amorphous vinyl polymer may be either miscible or immiscible with each other, but are desirable to be immiscible from the viewpoint of the pulverizability, antiblocking property, etc., of the toner. The term 'immiscible' herein implies that both are not of the nature that the structures of both are the same as or similar to each other, or are sufficiently dispersed by the function of a functional group, and it represents the case where the solubility parameter; e.g., the difference in the S.P. value according to the method by Fedors. Polym. Eng. Sci., 14, (2) 147 (1974) is not less than 0.5.

The toner of this invention needs to contain the copolymer comprised of the above crystalline polyester and the amorphous vinyl polymer accounting for at least 30% by weight, and preferably 50 to 100 by weight of the toner. The melting point Tm of the crystalline polyester, the glass transition point Tg of the amorphous vinyl polymer, and the average molecular weight and the pesk molecular weight are measured in the following manners:

Measurement of the melting point Tm of the Crystalline Polyester

The measurement can be carried out according to the differential scanning calorimetry (DSC); e.g., by means of the 'DSC-20' (manufactured by Seiko Electronic Industry Co.). Determination of the melting point Tm: The melting peak obtained when about 10 mg of a sample are heated at a given temperature increasing speed (10° C./min.) is regarded as the melting point.

Measurement of the Glass Transition point Tg of the Amorphous Vinyl Polymer

This measurement also may be performed according to the differential scanning calorimetry (DSC); e.g., by means of the 'DSC-20', (manufactured by Seiko Electronic Industry Co.): To be concrete, about 10 mg of a sample are heated at a given temperature increasing speed (10° C. min.), and a glass transition point is obtained from the intersecting point of the base line and the inclined curve of the heat absorption peak.

Measurement of the weight average molecular weight Mw and the number average molecular weight The values of the weight average molecular weight (Mw) and the number average molecular weight (Mn) can be found by various methods. There may be a slight difference in the value depending on the method used, but in this invention, the values were found according to the following measuring method Gel Permeation Chromatography (GPC) is used to measure the Mw and Mn under the following condition:

At 40° C. a solvent (tetrahydrofuran) is flowed at a speed of 1.2 ml per minute, and 3 mg of a tetrahydrofuran sample solution in a concentration of 0.2 g/20 ml, as the weight of the sample, is poured in to thereby perform a measurement. For the determination of the molecular weight of the sample, the measurement is made under a condition which is selected so that the molecular weight of the sample falls under the range where the logarithm and count number of the molecular weight on the calibration curve prepared with several monodisperse polystyrene reference samples become straight lines.

In addition, the reliability of the measured results can be confirmed by the fact that the NBS706 polystyrene reference sample used in the above measuring condition becomes of weight average molecular weight $Mw=28.8\times10^4$ and number average molecular weight $Mn=13.7\times10^4$.

The column to be used for GPC may be any column as long as it meets the above requirements. To be concrete, for example, TSK-GEL, GMH (manufactured by Toyo Soda), or the like may be used.

The solvent and the measuring temperature are not limited to the above-mentioned conditions; any other appropriate conditions may also be used.

The obtaining of the copolymer formed by the chemical combination of the foregoing crystalline polyester with the foregoing amorphous vinyl polymer can be carried out by, e.g., having the terminal function groups of the respective polymers directly combine with each other in the head-tail linkage mode by the coupling reaction therebetween, or by having the functional groups of the respective polymers combine through a bifunctional coupling agent; such as, for example, the urethane linkage formed by the reaction of a polymer whose terminal group is a hydroxyl group with a diisocyanate; the ester linkage formed by the reaction of a polymer whose terminal group is a hydroxyl group with a dicarboxylic acid or with a glycol; or other linkage formed by the reaction of a polymer whose terminal group is a hydroxyl group with phosgene with dichlorodimethylsilane.

Examples of the above coupling agent include bifunctional isocyanates such as, e.g., hexamethylene diisocyanate, diphenylethane diidsocyanate, tolylene diisocyanate, tolidine diisocyanate, naphthylene diisocyanate, isophorone diisocyanate, xylilene diisocyanate, etc.; bifunctional amines such as ethylenediamine, hexamethylenediamine, phenylenediamine. etc.; bifunctional carboxylic acids such as oxalic acid, succinic acid, adipic acid, sebacic acid, terephthalic acid, isophthalic acid, etc.; bifunctional alcohols such as ethylene glycol, propylene glycol, butane diol, pentane diol, hexane diol, cyclohexane dimethanol, p-xylilene glycol, etc.; bifunctional acid chlorides such as terephthalic acid chloride, isophthalic acid chloride, adipic acid chloride, sebacic acid chloride, etc.; and other bifunctional coupling agents such as diisothiocyanates, bisketene, biscarbodiimide, etc.

The coupling agent may be used in the amount range of from 1 to 10% by weight, and preferably from 2 to 7% by weight to the total weight of the crystalline polyester and the amorphous vinyl polymer. If it exceeds 10% by weight, the obtained copolymer tends to have an excessively high molecular weight which increases its softening point, resulting in the deterioration of the fixability of the resulting toner at a low temperature, while if it is less than 1% by weight, the molecular weight of the obtained copolymer is so small that the copolymer tends to be deteriorated in the anti-offset property and anti-filming property as well as in the durability.

The electrostatic image developing toner of this invention is one that is formed by incorporating a coloring agent into the binder comprising the above-mentioned specific copolymer, and the toner, if necessary, may also contain a magnetic material and a property-improving agent.

Usable materials as the coloring agent include, for example, carbon black, Nigrosine dye (C.I. No. 50415B), Aniline Blue (C.I. No 50405), Calco Oil Blue (C.I. No. azoic Blue 3), Chrome Yellow (C.1. No. 14090), Ultramarine Blue (C.I. No. 77103), DuPont Oil Red (C.I. No. 26105), Quinoline Yellow (C.I. No. 47005). Methylene Blue Chloride (C.I. No. 52015), Phthalocyanine Blue (C.I. NO. 74160), Malachite Green Oxalate (C.I. No. 42000), Lumpblack (C.I. No. 77266). Rosebengal (C.I. No. 45435), and a mixture of some of these dyes. The using amount of these coloring agents is generally from 0.1 to 20 parts by weight to 100 parts by weight of the toner, and particularly preferably from 0.5 to 10 parts by weight.

Examples of the foregoing magnetic material include ferrite, magnetite, and ferromagnetic metals such as iron, cobalt, nickel, etc., and alloys thereof, compounds containing these elements; those alloys which do not contain ferromagnetic elements but show ferromagnetism by being subjected to an appropriate heat treatment, which include such alloys containing manganese and copper, called whistler alloys, as manganese-copper-aluminum alloy, manganese-copper-tin alloy. etc.; and chromium dioxide, and the like, For example, in obtaining a black toner, magnetite, which in itself is black and so functions also as a coloring agent, may be particularly suitably used, in obtaining a colored toner, a material which is less dark in color such as metallic iron may be suitable. Among these magnetic materials there are those functioning as coloring agents, so that these materials may also be used as coloring agents. Such the magnetic material is uniformly dispersed in the fine-particulate form such as, e.g., of an average particle size of from 0.1 to 1 μm into the resin. And the content, if in the magnetic toner, is from 20 to 70 parts by weight, and preferably from 40 to 70 parts by weight to 100 parts by weight of the toner.

Examples of the foregoing property-improving agent include fixability-improving agent, charge-control agent, and the like.

Useful examples of the fixability-improving agent include polyolefins, fatty acid metallic salts, fatty acid esters, fatty acid ester-type waxes, partially saponified fatty acid solid esters, higher fatty acids, higher alcohols, liquid or solid paraffin waxes, polyamide-type waxes, polyhydric alcohol esters, silicone varnish, aliphatic fluorocarbon, and the like. Particularly, those waxes having a softening point of from 60° to 150° C. (according to ring and ball method: JIS K2531) are suitable.

As for the charge-control agent, those conventionally known may be used which include nigrosine-type dyes, metal-containing dyes, and the like.

Further, the toner of this invention is desirable to be used in a mixture with inorganic particulate materials as the fluidity-improving agent.

The above inorganic particulate material to be used in this invention is one whose primary particle size is from 5μ m to 2m μ, and preferably from 5 mμ to 500 m μ. The specific surface area according to the BET method is desirable to be 20 to 500 $m^2/g$. The mixing ratio of the particulate material into the toner is from 0.01 to 5% by weight, and preferably from 0.01 to 2.0% by weight, Examples of such the inorganic particulate material include, e.g., silica powder, alumina, titanium oxide, barium titanate, magnesium titanate, calcium titanate, strontium titanate, zinc oxide, quartz sand, clay, mica, silica lime, diatom earth, chromium oxide, cerium oxide, iron oxide red, antimony trioxide, magnesium oxide, zirconium oxide, barium sulfate, barium carbonate, calcium carbonate, silicon carbide, silicon nitride, and the like. Among these, the silica powder is particularly preferred.

The silica powder herein is a powdery material having the Si-O-Si linkage, and includes those produced in the dry process and in the wet process, and may be any of those such as anhydrous silicon dioxide, aluminum silicate, sodium silicate, potassium silicate, magnesium silicate, zinc silicate, etc., but ones containing not less than 85% by weight of $SiO_2$ are suitable.

Examples of these silica powdery materials include various commercially available silica materials, among which those having a hydrophobic group on the surface thereof are useful, such as AEROSIL R-972, R-974, R-805, R-812 (produced by Aerosil Co.) and Talax 500 (produced by Talco Co.), and the like. Besides, those silica powdery materials treated with silane coupling agent, titanium coupling agent, silicone oil, silicone oil having an amine group on the side chain thereof, or the like, may also be used.

A suitable example of the method for preparing the toner of this invention is such that a resin as a binder material or one prepared, if necessary, by incorporating a coloring agent into this is first fusedly kneaded by means of, e.g., an extruder and cooled, and then finely pulverized by a jet mill or the like, and subsequently this is classified, whereby a desirable particle size-having toner can be obtained, or alternatively the one fusedly kneaded by the extruder, as it is fused, is sprayed by a spray dryer or dispersed into a liquid, whereby a desirable particle size-having toner can be obtained.

The toner of this invention is used for developing the electrostatic image formed in e.g., an electrophotographic copying apparatus, and the obtained toner image is electrostatically transferred onto a copying paper, and then fixed by a heat roller fixing device, whereby a copy image can be obtained. And the toner of this invention can be suitably used especially where the fixation of the toner image on a copying paper is made in contact with a heat roller at such a high speed as a less than 1 second contact time, and particularly 0.5 second.

EXAMPLES

The present invention will be illustrated in detail by the following examples, but the invention is not limited to and by the examples.

Crystalline polyesters

Crystalline Polyester 1

In a 5-liter round-bottom flask equipped with a thermometer, stainless-steel stirrer, nitrogen-conducting glass pipe and coiled condenser were put 1500 g of sebacic acid and 964 g of hexamethylene glycol, this flask was placed in a mantle heater, then a nitrogen gas was conducted through the nitrogen-conducting glass pipe into the reaction flask, and then the temperature inside the flask was increased with the inside atmosphere being kept inert. And 13.2 g of p-toluenesulfonic acid were added to the mixture to perform a reaction at 150° C. The reaction was stopped when the amount of the water distilled out reached 250 ml, and the reaction system was cooled to room temperature, whereby Crystalline Polyester 1 was obtained which was comprised of a polyhexamethylene sebacate having a hydroxyl group at the terminal of the molecule thereof. The melting point of the obtained Crystalline Polyester 1 (the value obtained by measurement using a differential scanning calorimeter DSC-20, manufactured by Seiko Electronic Industry Co.; the same shall apply hereinafter) was 64° C., and the weight average molecular weight Mw of the same was 14,000.

Crystalline Polyesters 2 to 4

The following four different Crystalline Polyesters 2 to 4 were obtained in similar manner to that of Crystalline Polyester 1.

Crystalline Polyester 2

Polyethylene sebacate having a melting point Tm of 72° C. and a weight average molecular weight Mw of 12,800.

Crystalline Polyester 3

Polyethylene succinate having a melting point Tm of 92° C. and a weight average molecular weight Mw of 14,800.

Crystalline Polyester 4

Polydecamethylene adipate having a melting point Tm of 77° C. and a weight average molecular weight Mw of 8,370.

Crystalline Polyester 5

1300 g of sebacic acid and 797 g of hexamethylene glycol were used in the same manner as in Crystalline Polyester 1 to thereby produce Crystalline Polyester 5 having a carboxyl group at the terminal of the molecule thereof. The melting point Tm and the weight average molecular weight Mw of the obtained Crystalline Polyester were 69° C. and 10,5090, respectively.

Amorphous Vinyl Polymers

Amorphous Vinyl Polymer 1

A mixture of the compositions A given in Table 1 below was put in a 1-liter separable flask containing 100 parts by weight of toluene. The air inside the flask was replaced by a nitrogen gas, and the inside of the flask was heated up to 80° C. and kept at this temperature for 15 hours to perform the first step polymerization of the monomers. After that, the reaction system was cooled down to 40° C., at which monomer composition B shown in Table 1 was added. After stirring the reaction mixture for 2 hours at this temperature, the reaction system was heated again to 80° C. and, while maintaining the temperature at 80° C. for 8 hours, the second step polymerization was completed. Then the reaction system was cooled down and solid portion of the reaction product was separated. After repeating dehydration and rinsing, a polymer containing therein carboxylic groups and comprising high molecular weight component (hereinafter referred to as 'H-component') and low molecular weight component (hereinafter referred to as 'L-component') was obtained. The peak molecular weights of 'H-component' and 'L-component' were 345.800 and 8,190, respectively, and the glass transition point (Tg) and softening point ($T_{sp}$) of the thus obtained polymer were 67° C. and 134° C., respectively.

TABLE 1

| Monomer | Amount Added (Parts by Weight) Composition A | Composition B |
|---|---|---|
| Styrene | 15 g (75 Parts) | 85 g (85 Parts) |
| n-Butyl-acrylate | 5 g (25 Parts) | — |
| n-Butyl-methacrylate | — | 10 g (10 Parts) |
| Acrylic acid | — | 5 g (5 Parts) |
| Benzoyl peroxide | 0.04 g (0.2 Parts) | 4 g (4 Parts) |

Amorphous Vinyl Polymer 2

H-component monomer mixture of 30 g, which consists of 65 parts by weight of styrene and 35 parts by weight of ethyl hexylmethacrylate, the weight average molecular weight and the glass transition point of which polymer are 300,000 and 53° C., respectively, and 100 g of L-component monomer mixture, which consists of 95 parts by weight of styrene and 5 parts by weight of α-ethylacrylic acid, and the weight average molecular weight and the glass transition point of which polymer are 6,000 and 63° C., respectively, were used to synthesize, in the same manner as in Amorphous Vinyl Polymer 1, a carboxyl group-having Amorphous Vinyl Polymer 2. The peak molecular weight of 'H-component' and 'L-component' were 281,800 and 4,470, respectively, and the glass transition point Tg and the softening point $T_{sp}$ the polymer were 62° C. and 139° C., respectively.

Amorphous Vinyl Polymer 3

H-component monomer mixture of 10 g, which consists of 70 parts by weight of methyl methacrylate, 15 parts by weight of stearyl methacrylate and 15 parts by weight of 2-ethyl hexylacrylate, the weight average molecular weight and the glass transition point of which polymer are 280,000 and 51° C. respectively, and 100 g of L-component monomer mixture, which consists of 90 parts by weight of methylmethacrylate, 5 parts by weight of n-butylmethacrylate and 5 parts by weight of acryloyloxy ethylmonosuccinate and the weight average molecular weight and the glass transition point of which polymer are 13,000 and 68° C., respectively, were used to synthesize, in the same manner as in Amorphous Vinyl Polymer 1, a carboxyl group-having Amorphous Vinyl Polymer 3. The peak molecular weight of 'H-component' and 'L-component' of the thus obtained polymer were 251,200 and 4,470, respectively, and the glass transition point Tg and the softening point $T_{sp}$ the polymer were 63° C. and 129° C., respectively.

Amorphous Vinyl Polymer 4

By the use of 30 g of monomer mixture for 'H-component' and 100 g of monomer mixture for 'L-component', of which monomer compositions are given in Table 2, Amorphous Vinyl Polymer 4 containing therein hydroxy groups was synthesized in the same manner as Amorphous Vinyl Polymer 1. The peak molecular weights of 'H-component' and 'L-component' of the thus obtained polymer were 324,000 and 6,300, respectively, and the glass transition point (Tg) and softening point ($T_{sp}$) were 59° C. and 130° C., respectively.

TABLE 2

| Monomer | Amount Added (Parts by Weight) H-component | L-component |
|---|---|---|
| Styrene | 75 Parts | 85 Parts |
| n-Butyl-acrylate | 25 Parts | — |
| n-Butyl-methacrylate | — | 12.5 Parts |
| Hydroxyethyl methacrylate | 5 Parts | 2.5 Parts |
| Benzoyl peroxide | 0.2 Parts | 4 Parts |

Amorphous Vinyl Polymer 5

By the use of 30 g of monomer mixture for 'H-component' and 100 g of monomer mixture for 'L-component', of which monomer compositions are given in Table 3, Amorphous Vinyl Polymer 5 containing amino groups therein was synthesized in the same manner as amorphous binyl copolymer 1. The peak molecular weights of 'H-component' and 'L-component' of the thus obtained polymer were 364,500 and 5,870, respectively and the glass transition point (Tg) and softening point ($T_{sp}$) were 60° C. and 131.5° C., respectively.

TABLE 3

| Monomer | Amount Added (Parts by Weight) H-component | L-component |
|---|---|---|
| Styrene | 65 Parts | 90 Parts |
| 2-Ethylhexyl methacrylate | 35 Parts | — |
| n-Butyl-methacrylate | — | 5 Parts |
| p-Aminostyrene | — | 5 Parts |
| Benzoyl peroxide | 0.2 Parts | 4 Parts |

Amorphous Vinyl Polymer 6

By the use of 30 g of monomer mixture for 'H-component and 100 g of monomer mixture for 'L-component', of which monomer compositions are given in Table 4, Amorphous Vinyl Polymer 6 containing therein epoxy groups was synthesized in the same manner as Amorphous Vinyl Polymer 1. The peak molecular weights of 'H-component' and 'L-component' of the thus obtained polymer were 356,500 and 4,300, respectively, and the glass transition point (Tg) and softening point ($T_{sp}$) were 62° C. and 138.5° C., respectively.

TABLE 4

| Monomer | Amount Added (Parts by Weight) H-component | L-component |
|---|---|---|
| Styrene | 75 Parts | 85 Parts |
| n-Butyl-acrylate | 20 Parts | — |
| n-Butyl-methacrylate | — | 12.5 Parts |
| Grycidyl-methacrylate | 5 Parts | 2.5 Parts |
| Benzoyl peroxide | 0.2 Parts | 4 Parts |

Amorphous Vinyl Polymer 7

Ninety parts by weight of styrene, 5 parts by weight of n-butyl methacrylate and 5 parts by weight of methacrylic acid were used, and in the same manner as in Amorphous Vinyl Polymer 1, a carboxyl group-having Amorphous Vinyl Polymer 7 was obtained, which had only one peak molecular weight of 31,600 in its molecular weight distribution curve, a glass transition point Tg of 65° C. and a softening point Tsp of 142° C.

Copolymers

Copolymer A

Fifteen parts by weight of Crystalline Polyester 1, 85 parts by weight of Amorphous Vinyl Polymer 1, 0.05 parts by weight of p-toluenesulfonic acid and 100 parts by weight of xylene were put in a 3-liter separable flask, and the mixture was refluxed at 150° C. for one hour, and then the xylene was distilled off by using an aspirator and a vacuum pump, whereby Graft Copolymer A was obtained.

Copolymers B through D, H and I

The crystalline polyesters and the amorphous vinyl polymers given in Table 5 were used, and in the same manner as in Copolymer A, Graft Copolymers B through D, and H and I were obtained.

Copolymer E

The crystalline polyester and the amorphous vinyl polymer given in Table 1 were used, and Graft Copolymer E was obtained in the same manner as in Copolymer A except that the p-toluenesulfonic acid was replaced by 2 parts by weight of hexamethylene diisocyanate added dropwise.

Copolymers F and G

The crystalline polyesters and the amorphous vinyl polymers given in Table 1 were used, and Graft Copolymers F and G were obtained in the same manner as in Copolymer A except that p-toluenesulfonic acid was not used.

EXAMPLES 1 through 7

One hundred parts by weight of each of the above-obtained Copolymers A through G, 10 parts by weight of carbon black 'Mogal L' (produced by Cabot Co.), 3 parts by weight of polypropylene 'Biscol 660P' (produced by Sanyo Chemical Industry Co.; Softening Point: 145° C.) and 3 parts by weight of 'Wax-E' (produced by Hoecht Co.; Softening Point: 78° C.) were mixed and kneaded by a heat roller and then cooled, and further finely pulverized by means of an ultrasonic jet mill and subsequently classified by means of an aeroclassifier, whereby a colored particulate material was obtained.

One hundred parts by weight of this colored particulate material was mixed by a V-type mixer with 0.8 part by weight of a hydrophobic silica powdery material 'AEROSIL R-972' (produced by Aerosil Co, Primary Average Grain Size: 16mμ BET Surface Area: $120m^2/g$) whereby 7 different toners of this invention, each having an average particle size of 11.0 μm, were prepared, These obtained toners are referred to as Toner 1 through Toner 7.

COMPARATIVE EXAMPLES 1 and 2

Two different comparative toners were prepared in the same manner as in Examples except that Copolymers H and I were used. These comparative toners were regarded as Comparative Toner 1 and Comparative Toner 2.

COMPARATIVE EXAMPLE 3

The crystalline polyester and the amorphous vinyl polymer given in Table 5 were used and processed in the same manner as in Copolymer A except that the p-toluenesulfonic acid was removed, whereby a blended resin of the crystalline polyester with the amorphous vinyl polymer was prepared. After that, a comparative toner was prepared in the same manner as in Examples except that the above blended resin was used. This comparative toner was regarded as Comparative Toner 3.

Each of the thus obtained Toners 1 through 7 and Comparative Toners 1 through 3 was tested as follows: Three parts by weight of each toner and 97 parts by weight of 100 μm-average grain size-having carrier beads coated with a styrene-methyl methacrylate copolymer resin were mixed, whereby a developer was prepared. This developer was used in an electrophotographic copying apparatus 'U-Bix 1600' (manufactured by Konishiroku Photo Industry Co., Ltd.) to perform a copying test in the manner that an electrostatic image was formed and developed, and the obtained toner image was transferred onto a copying paper and then fixed by a heat roller fixing device, thereby forming a copy image. At this time, the minimum fixing temperature (fixable lowest temperature of the heat roller) and offset-producing temperature (offset phenomenon-producible lowest temperature) were measured, and also the fixable range was found in the manner given hereinafter. Further, by the use of a partly modified 'U-Bix 2800MR' (A Copying Apparatus Manufactured by Konishiroku Photo Industry Co. Ltd.), wherein a heat roller with teflon surface and a backup roller with silicone rubber surface were used in the fixing device and the temperature of the heat roller was set at 160° C., continuously repeated copying image forming tests using the respective developers mentioned hereinabove were carried out for 50,000 times under the atmosphere of a temperature at 20° C. and a relative humidity at 60%.

Minimum Fixing Temperature

In the above electrophotographic copying apparatus was prepared an unfixed image formed with the sample toner transferred onto a 64 $g/m^2$ copying paper sheet, and then the toner image on the sheet of paper was fixed at a linear speed of 70 mm/second, under linear pressure of 0.8 kg/cm, and in a nipping width of 4.9 mm by a fixing device consisting of a juxtaposed pair of rollers, one being a 30 mm diameter-having heat roller whose surface is formed with Teflon (polytetrafluoroethylene; produced by DuPont), the other being a pressure roller whose surface is formed with a silicone rubber 'KE-1300RTV' (produced by Shin'etsu Chemical Industry Co.). This fixing manner was repeated at each step of increasing by 5° C. within the heat roller's setting temperature range of from 80° C. to 240° C., and each fixed image thus formed was subjected to kimwipe rubbing treatment, and the lowest of the temperature range set for fixing the images showing adequate resistance to the rubbing was regarded as the minimum fixing temperature. The fixing device used herein has no silicone oil supply mechanism.

Offset-Producing Temperature

The measurement of the offset-producing temperature is made in similar manner to the minimum fixing temperature: After preparing an unfixed image in the foregoing copying apparatus, the toner image is transferred onto a white copying sheet of paper and then fixed by the foregoing fixing device. The toner image-carrying white paper is again made pass through the fixing device under the same condition to look into whether the rollers are stained or not by the toner. This procedure is repeated with the fixing temperature of the heat roller of the fixing device being increased by degrees, and the lowest of the temperature range that caused toner stain was regarded as the offset-producing temperature.

Fixable range

The difference between the offset-producing temperature and the minimum fixing temperature was regarded as the fixable range.

The results are shown in Table 5.

Further, with respect to each of the toners prepared by using the above toners, the amount of charge (Q/M) was measured in the following manner.

Amount of Charge (Q/M)

The amount of charge is the value of the amount of the charge caused by triboelectrification per gram of a toner measured according to the blow-off method Of the prior art.

Further, each of the images formed by using the above toners was measured and evaluated with respect to the maximum image density (Dmax) and the sharpness in the following procedure:

Maximum Image Density (Dmax)

The maximum image density was given in terms of the relative density of a developed image to the original image density 1.3. The measurement was made by using a SAKURA densitometer (manufactured by Konishiroku Photo Industry Co.. Ltd.).

Sharpness

A line drawing was used as an original image, and the reproduction in each developed image from the original image was enlarged and judged visually.

The obtained results are as shown in Table 5.

TABLE 5

| Example | Toner | | Crystalline polyester No. | Amorphous vinyl polymer No. | LP | HP | Ratio | Min. fix temp (°C.) | Offset-producing temp (°C.) | Fixable temp range (°C.) | Amount of charge (Q/M) | Max. image density (Dmax) | Sharpness | Copying Durability After 50,000 copies |
|---|---|---|---|---|---|---|---|---|---|---|---|---|---|---|
| Example 1 | Toner 1 | A | 1 | 1 | 8,910 | 354,800 | 10/90 | 110 | 240 | 130 | −19.8 | 1.32 | Good | Good |
| Example 2 | Toner 2 | B | 2 | 1 | 8,910 | 354,800 | 30/70 | 100 | 230 | 130 | −14.4 | 1.30 | Good | Good |
| Example 3 | Toner 3 | C | 3 | 2 | 4,470 | 281,800 | 15/85 | 110 | 220 | 110 | −12.1 | 1.30 | Good | Good |
| Example 4 | Toner 4 | D | 4 | 3 | 4,470 | 251,200 | 5/95 | 120 | 220 | 100 | −15.4 | 1.33 | Good | Good |
| Example 5 | Toner 5 | E | 1 | 4 | 6,300 | 324,000 | 15/85 | 105 | 185 | 80 | −18.3 | 1.32 | Good | Good |
| Example 6 | Toner 6 | F | 5 | 5 | 5,870 | 364,500 | 20/80 | 100 | 200 | 100 | −17.5 | 1.28 | Good | Good |
| Example 7 | Toner 7 | G | 5 | 6 | 4,300 | 356,000 | 50/50 | 95 | 170 | 75 | −23.4 | 1.30 | Good | Good |
| Comparative Example 1 | Comp. toner 1 | H | 1 | 7 | 33,500 | (One Peak) | 30/70 | 120 | 150 | 30 | −16.2 | 1.15 | Poor | Roller Stained after about 5000th Copy |
| Comparative Example 2 | Comp. toner 2 | I | — | 1 | 6,680 | 501,200 | 0/100 | 150 | 240 | 90 | −16.5 | 1.30 | Good | Fixing Dissatisfactory from the beginning |
| Comparative Example 3 | Comp. toner 3 | — | 5 | 1 | 8,910 | 354,000 | 10/90 | 150 | 150* | 0 | −10.2 | 1.30 | Poor | Roller Stained after about 3,00th Copy |

Note: *Offset phenomenon occurs on the entire surface.

What is claimed is:

1. An electrostatic image developing toner, which is a powder under ambient conditions, comprising a colorant, a block copolymer or graft copolymer as a binder component, said block or graft copolymer comprising components taken from the class consisting of 3% to 50% by weight based on said copolymer, of a crystalline polyester and an amorphous vinyl polymer bearing a functional group chemically bonded with said crystalline polyester, said amorphous vinyl polymer having at least two peaks in its molecular weight distribution curve, one of said peaks being between 100,000 and 1,000,000, and another of said peaks being between 2,000 and 20,000.

2. The electrostatic image developing toner of claim 1, wherein melting point of said crystalline polyester is within the range from 50° to 120° C. and glass transition point of said amorphous vinylpolymer is within the range from 50 to 100° C.

3. The electrostatic image developing toner of claim 1, wherein said crystalline polyester has a weight average molecular weight of 5,000 to 50,000 and a number average molecular weight of 2,000 to 20,000.

4. The electrostatic image developing toner of claim 1, wherein the proportion of said crystalline polyester with respect to the block or graft copolymer is 5 to 40% by weight.

5. The electrostatic image developing toner of claim 1, wherein said toner comprises a wax having a softening point by ring and ball method of 60° to 150° C.

6. The electrostatic image developing toner of claim 1, wherein said toner is covered with an inorganic fine powder.

7. The toner of claim 1 wherein said curve is formed by phased polymerization of the monomers substantially composing said amorphous vinyl polymer.

8. The toner of claim 1 wherein at least one monomer has a carboxyl group, a hydroxyl group, an amino group or an epoxy group adapted to provide said polymer with said functional group.

9. The toner of claim 8 wherein a content of said component is 0.1 to 20 mol %.

10. The toner of claim 9 wherein said content is 0.5 to 10 mol %.

11. The toner of claim 1 wherein a glass transition point of said polymer is 50° to 100° C.

12. The toner of claim 11 wherein said glass transition point is 50° to 80° C.

13. The toner of claim 1 wherein said functional group is at least one selected from the group consisting of a carboxyl, hydroxyl, amino, and epoxy.

14. The toner of claim 1 herein a melting point of said polyester is 50° to 120° C.

15. The toner of claim 14 wherein said melting point is 50° to 100° C.

16. The toner of claim 1 wherein said copolymer is more than 30 weight % of said toner.

17. The toner of claim 16 wherein the content is 50° to less than 100 weight %.

18. The toner of claim 1 wherein said toner contains an inorganic particulate material as a fluidity-improving agent.

19. The toner of claim 18 wherein a primary particle size of the said material is 5 mμ to 2 μm.

20. The toner of claim 19 wherein the particle size is 5 mμ to 500 mμ.

21. The toner of claim 18 wherein a content of said material is 0.01 to 5.0 weight %.

22. The toner of claim 21 wherein the content is 0.01 to 2.0 weight %.

23. The toner of claim 18 wherein said material is hydrophobic silica.

24. The toner of claim 1 wherein said group is hydroxyl.

25. An electrophotographic method comprising developing a toner image from an electrostatic latent image with a toner comprising a block copolymer or graft copolymer as a binder, said copolymer formed by block or graft copolymerization of components taken from the class consisting of 3% to 50% by weight, based on said copolymers, of a crystalline polyester and an amorphous vinyl polymer having a functional group which is capable of forming a chemical bond with said crystalline polyester, said amorphous vinyl polymer having at least two peaks in its molecular weight distribution curve, one of said peaks being between 100,000 and 1,000,000, and another of said peaks being between 2,000 and 20,000, and heat-fixing said toner image on a recording sheet by at least one heated roller.

26. The method of claim 25 wherein a content of the block or graft copolymer in the toner is more than 30 weight %.

27. The method of claim 26 wherein said curve is formed by phased polymerization of the monomers substantially composing said amorphous vinyl polymer.

28. The method of claim 26 wherein said functional group is carboxyl, hydroxyl, amino, or epoxy.

29. The method of claim 28 wherein said functional group is 0.1 to 20 mol % of said polymer.

30. The method of claim 29 wherein said functional group is 0.5 to 10 mol % of said polymer.

31. The method of claim 26 wherein said polymer has a glass transition temperature of 50° to 100° C.

32. The method of claim 31 wherein said temperature is 50° C. to 80° C.

33. The method of claim 26 wherein said polyester has a melting point of 50° to 120° C.

34. The method of claim 33 wherein said melting point is 50° to 100° C.

35. The method of claim 26 wherein said polyester has a weight molecular weight of 5,000 to 50,000 and a number molecular weight of 2,000 to 20,000.

36. The method of claim 26 wherein said polyester is 5% to 40% by weight of said copolymer.

37. The method of claim 26 wherein said copolymer is more than 30% and less than 100% by weight of said toner.

38. The method of claim 37 wherein said copolymer is more than 50% of said toner.

39. The method of claim 26 wherein said toner further comprises a wax having a softening point of 60° to 150° C. by the ring and ball method.

40. The method of claim 26 wherein said toner contains an inorganic particulate material as a fluidity improving agent.

41. The method of claim 40 wherein a primary particle size of the inorganic particulate material is 5 mμ to 2 μm.

42. The method of claim 41 wherein the particle size is 5 mμ to 500 mμ.

43. The method of claim 40 wherein a content of said inorganic particulate material is 0.01 to 5.0 weight % of said toner.

44. The method of claim 43 wherein said content is 0.01 to 2.0 weight %.

45. The method of claim 40 wherein the inorganic particulate material is a hydrophobic silica powder.

46. The method of claim 26 wherein a heat roller with a surface coated with a fluorinated polymer is provided for contact with said toner image.

47. The method of claim 25 wherein at least one of the components has a carboxyl group, a hydroxyl group, an amino group or an epoxy group, which can provide the amorphous vinyl polymer with the functional group.

48. The method of claim 25 wherein said group is hydroxyl.

* * * * *